US005123983A

United States Patent [19]

Marshall

[11] Patent Number: 5,123,983

[45] Date of Patent: Jun. 23, 1992

[54] GAS MANAGEMENT SYSTEM FOR CLOSELY-SPACED LAYDOWN JETS

[75] Inventor: Larry R. Marshall, Chesterfield, Va.

[73] Assignee: E. I. du Pont de Nemours and Company, Wilmington, Del.

[21] Appl. No.: 571,725

[22] Filed: Aug. 24, 1990

[51] Int. Cl.[5] ..... B29C 47/08

[52] U.S. Cl. ..... 156/167; 156/181; 264/205; 264/518

[58] Field of Search ..... 156/167, 181; 264/518, 264/205, 206; 425/66, 72.1; 65/4.4

[56] References Cited

U.S. PATENT DOCUMENTS

| | | | |
|---|---|---|---|
| 2,732,885 | 1/1956 | Van Der Hoven | 65/4.4 |
| 3,384,944 | 5/1968 | Medeiros et al. | 425/66 |
| 3,387,326 | 6/1968 | Hollberg et al. | 18/8 |
| 3,477,103 | 11/1969 | Troth, Jr. | 19/163 |
| 3,497,918 | 3/1970 | Pollock, Jr. et al. | 18/2.6 |
| 3,504,076 | 3/1970 | Lee | 264/205 |
| 3,565,729 | 2/1971 | Hartmann | 156/167 |
| 3,802,817 | 4/1974 | Matsuki et al. | 425/66 |
| 3,860,369 | 1/1975 | Brethauer et al. | 425/3 |
| 3,949,130 | 4/1976 | Sabee et al. | 156/167 |
| 4,089,720 | 5/1978 | Haley | 156/167 |
| 4,148,595 | 4/1979 | Bednarz | 425/75 |
| 4,276,106 | 6/1981 | Porter | 156/181 |
| 4,487,622 | 12/1984 | Battigelli et al. | 65/4.4 |
| 4,997,611 | 3/1991 | Hartmann | 156/167 |

*Primary Examiner*—Michael W. Ball
*Assistant Examiner*—Steven D. Maki

[57] ABSTRACT

An improvement is disclosed for reducing or even preventing interferences or interactions between adjacent, closely-spaced laydown jets utilized in a fibrous sheet laydown process. The improvement comprises positioning an inverted "V-shaped" baffle between adjacent, closely-spaced laydown jets so that the turbulent gas streams produced by each laydown jet are diverted and vented away from the area of sheet laydown on a moving collection belt. The baffle vents the fountain of gas produced by the collision of adjacent laydown jets in a cross-direction to that of the direction of belt movement.

8 Claims, 5 Drawing Sheets

GAS MANAGEMENT SYSTEM FOR CLOSELY-SPACED LAYDOWN JETS

FIELD OF THE INVENTION

The present invention relates management system for improving the uniformity of a spunbonded fibrous sheet wherein the fibrous material comprising the sheet is conveyed onto a collection device by adjacent, closely-spaced laydown jets. In particular, the invention relates to an improvement in a fibrous sheet laydown process wherein exhaust gas is vented away from the area of sheet formation in a cross-direction to the direction of laydown after the fibrous material has been conveyed onto the collection device by the closely-spaced laydown jets.

BACKGROUND OF THE INVENTION

Typical spunbonded processes utilize a series of spaced-apart spinneret assemblies to convey a fibrous material from a spinning orifice onto a foraminous collection belt. Multiple spinneret assemblies are often located downstream from one another in order to lay down a number of overlapping layers of the fibrous material. The fibrous material is conveyed to the collection belt in a stream of gas. A typical system is disclosed in Troth, Jr., U.S. Pat. No. 3,477,103, the contents of which are incorporated herein by reference. The fibrous material is separated from the gas stream and electrostatically pinned to the surface of the collection belt. The spent gas stream is exhausted away from the belt in some fashion. In many processes, this is done by sucking the gas stream through the foraminous belt.

However, if the fibrous material is relatively dense, so that it clogs the openings in the foraminous belt, or if the collection belt is impermeable to the flow of gas (e.g., rubber), the gas stream cannot be effectively exhausted by sucking it through the belt. If the spinneret assemblies are spaced far enough apart, the gas streams produced by the spin orifices will not interact nor interefere with each other and the gas will simply dissipate as it travels along the collection belt. However, if the spinneret assemblies are spaced too close together, the gas streams produced by the spin orifices will interact and interfere with each other and adversely affect laydown of fibrous material at adjacent positions along the collection belt. This latter condition greatly affects sheet uniformity.

A spunbonded fibrous sheet comprised of plexifilaments of flash-spun polyethylene is described in Lee, U.S. Pat. No. 3,504,076, the contents of which are incorporated by reference herein. The spin-cell apparatus used to form the plexifilaments (shown in FIG. 1 of Lee) utilizes a number of spin orifices spaced across the width of the apparatus and positioned downstream one from the other. In a subsequent improvement to Lee, the spin orifices are further equipped with rotating baffles and aerodynamic shields to direct the gas streams downwards toward the collection belt. The downwardly directed gas streams are often referred to as laydown jets. The aerodynamic shields are shown in Brethauer et al., U.S. Pat. No. 3,860,369, the contents of which are incorporated by reference herein.

When a gas stream conveying fibrous material is directed downward so that it impacts the belt, approximately half the flow is diverted in a generally upstream direction with respect to the moving belt and approximately half the flow is diverted in a generally downstream direction with respect to the moving belt. These flows are typically turbulent in nature and remain so until they slowly lose velocity as they travel along a sufficient length of the belt. When gas streams (i.e., laydown jets) are closely-spaced in the machine direction, so that one gas stream which travels along the belt collides with an adjacent gas stream, the flows are diverted in a more upward direction thereby generating a turbulent fountain or plume of exhaust gas. The resulting plume recirculates into the flow path of the downwardly directed laydown jets causing instabilities and disruptions in the uniform formation of the fibrous sheet. The closer the machine spacing between laydown jets, the more severe the disruptions caused by these uncontrolled turbulent flow patterns.

While the Lee-Brethauer apparatus works satisfactorily when the laydown jets are spaced far apart, it is not nearly so satisfactory when the laydown jets are close together as would be desired for several reasons. These reasons include: (1) investment is reduced when the spin-cell and enclosed spinneret assembly are made smaller in size; (2) sheet uniformity is improved by increasing the number of laydown positions and thereby the number of overlapping layers of fibrous material that make up the spunbonded sheet; and (3) spinneret assembly capacity is increased by increasing the number of laydown positions or the throughput per laydown position.

Clearly, what is needed is a gas management system which reduces or even prevents interferences or, interactions between the gas streams of adjacent, closely-spaced laydown jets. Other objects and advantages of the invention will become apparent to those skilled in the art upon reference to the attached drawings and to the detailed description of the invention which hereinafter follows.

SUMMARY OF THE INVENTION

In accordance with the invention, there is provided an improvement in a fibrous sheet laydown process which reduces or even prevents interferences or interactions between the exhausted gas streams of adjacent, horizontally closely-spaced laydown jets. In particular, the invention relates to an improvement in a fibrous sheet laydown process in which fibrous material is conveyed by a plurality of laydown jets onto a moving collection device to form a dense, non-woven sheet on the collection device, and wherein the laydown jets are positioned downstream from one another and at a distance in which the machine direction spacing between the laydown jets is less than five (5) times the vertical distance between the issue point of the laydown jets and the surface of the collection device. The improvement comprises positioning deflector means between adjacent, horizontally spaced laydown jets and above the surface of the collection device in order to cross-directionally vent the exhausted gas streams away from the area of sheet laydown.

In a preferred embodiment, the deflector means comprises an inverted "V-shaped" baffle with a span and height of about one half the horizontal distance between the closely-spaced laydown jets in the machine direction. The baffle is preferably comprised of a non-conductive material (e.g., Lucite® an acrylic sheet material commercially available from E. I. du Pont de Nemours & Co.) so that the electrostatically charged fibrous material which is being conveyed by the gas streams is not attracted to any grounded surfaces. However, in some applications the baffle may be comprised of a conductive material.

As used herein, the term "closely-spaced" means that the horizontal distance between successive laydown jets, i.e., adjacent laydown jets along the machine direction of web travel, is short enough so that the gas streams produced by the laydown jets significantly interfere or interact with each other in the area of sheet formation along the collection device. For purposes of the invention, this occurs if the machine direction spacing between adjacent laydown jets is less than about five (5) times the vertical distance between the issue point of the laydown jets and the surface of the collection belt.

As used herein, the term "laydown jet" means a downwardly directed flow or stream of gas issuing from a spinneret assembly which transports fibrous material onto a collection device.

As used herein, the term "fibrous material" means any filamentary material of the types appropriate in the textile art, these including any fibril, fibrid, fiber, filament, thread, yarn, or filamentary structure, regardless of length, diameter, or composition, although in preferred form the invention is particularly applicable to materials in the form of continuous filaments and more particularly to synthetic organic polymeric fibrous materials.

BRIEF DESCRIPTION OF THE DRAWINGS

The invention will be better understood with reference to the following figures.

DETAILED DESCRIPTION OF THE PREFERRED EMBODIMENT

Figure 1:
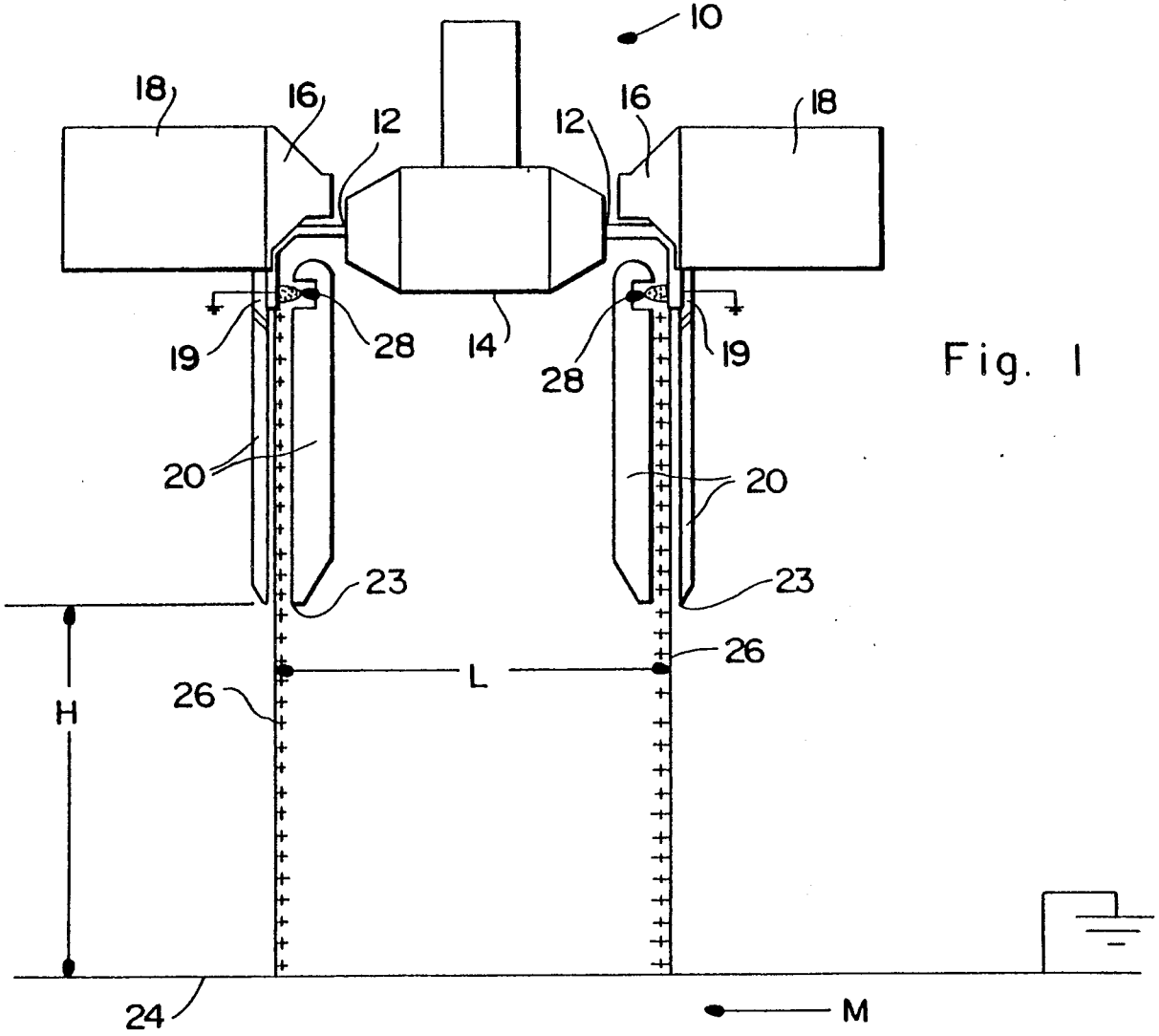
FIG. 1 is a cross-sectional view of a double end spinneret assembly having two closely-spaced laydown jets issuing therefrom.

Referring now to the drawings, wherein like reference numerals indicate like elements, there is shown in FIG. 1 a double end spinneret assembly 10 having two closely-spaced laydown jets 26 issuing therefrom. The laydown jets 26 convey fibrous material onto a grounded collection belt 24 moving in direction M. The double end spinneret assembly 10 comprises a spinneret pack 14 having a pair of spin orifices 12. The spin orifices 12 direct gas and fibrous material onto internally housed rotating-lobed deflectors 16 driven by electric motors 18. The rotating-lobed deflectors 16 direct gas and fibrous material downward towards the collection belt 24 as a pair of laydown jets 26. The laydown jets 26 are surrounded by aerodynamic shields 20 in order to protect the jets before they exit from issue points 23.

In order to provide for more closely-spaced laydown jets 26, each laydown position used in the process described in U.S. Pat. No. 3,860,369 is replaced by the double end spinneret assembly 10 or "two-in-one" pack. This assembly allows the laydown jets 26 to be positioned much closer to each other than with the three (3) foot distance commonly practiced commercially with separate single packs. In use, the laydown jets 26 are produced by flash-spinning plexifilaments of fibrous material, preferably polyethylene, with a high velocity transporting gas from each spin orifice 12 of the double end spinneret assembly 10. The spinneret assembly 10 contains a pair of internal three lobed rotating deflectors 16 as described in U.S. Pat. No. 3,497,918 in order to direct the fibrous material downward and to spread out the plexifilaments to form an interconnected web. The deflector 16 oscillates the web in the cross-direction and distributes the web mass or swath across the moving collection belt 24. The direction of belt movement M is referred to as the machine direction while the direction perpendicular to the direction of belt movement is referred to as the cross-direction. As the fibrous material is flash-spun, the resulting web is positively charged by a corona formed by ion gun 28 and target plate 19 in order to facilitate pinning of the web on the grounded collection belt 24.

Advantageously, a plurality of double end spinneret assemblies 10 are positioned above collection belt 24 in order to form multiple fibrous sheet layers. The issue points 23 from the double end spinneret assemblies 10 are preferably spaced approximately 10.5 inches apart in the horizontal machine direction and approximately 10 inches above the surface of collection belt 24. In FIG. 1, the horizontal machine direction distance between issue points 23 is designated as "L" and the distance between each issue point 23 and the belt surface 24 is designated as "H". As noted before, under normal circumstances, this arrangement produces unstable gas stream interactions which result in lower sheet uniformity and machine continuity problems.

Figure 2:
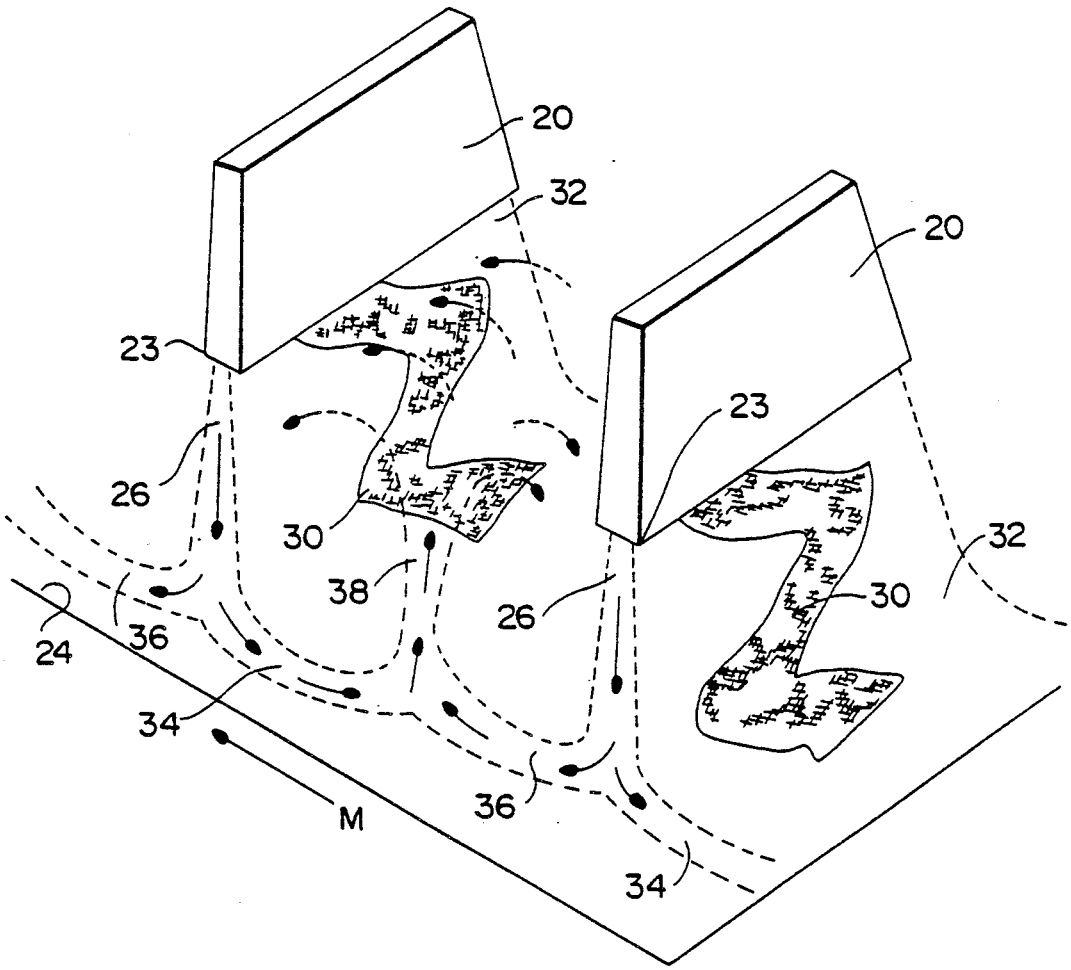
FIG. 2 is a simplified view of a double end spinneret assembly illustrating the turbulent flow patterns produced by two closely-spaced laydown jets as the jets impact a collection belt.

Referring now to FIG. 2, a simplified view of the double end spinneret assembly 10 of FIG. 1 is shown having laydown jets 26 issuing therefrom. The laydown jets 26 are shown in greater detail as a swath of fibrous material 30 being transported by a gas 32. The swath 30 and transporting gas 32 issue from the bottom of aerodynamic shields 20 (i.e, issue points 23). The figure further illustrates the flow patterns produced when two adjacent, closely-spaced laydown jets 26 impact the belt surface 24. As the swath 30 and transporting gas 32 making up each laydown jet impact the belt 24, approximately half of the transporting gas is diverted about 90 degrees upstream 34 with respect to the moving belt and approximately half of the transporting gas is diverted about 90 degrees downstream 36 with respect to the moving belt. The electrostatically charged swath 30 forms a fibrous sheet on the belt surface 24. When gas streams 34 and 36 collide along the belt surface, a turbulent fountain or plume of upwardly moving exhaust gas 38 is produced. The resulting fountain of turbulent exhaust gas 38 recirculates into the flow path of the laydown jets 26 comprising swath 30 and transporting gas 32. This recirculation causes severe instabilities and disruptions in the uniformity of the fibrous sheet. These disruptions will not only occur between closely-spaced laydown jets of the same double end spinneret assembly but also occur between the laydown jets of different double end spinneret assemblies (not shown) as they are utilized in succession to laydown fibrous material along the collection belt 24.

Figure 3:
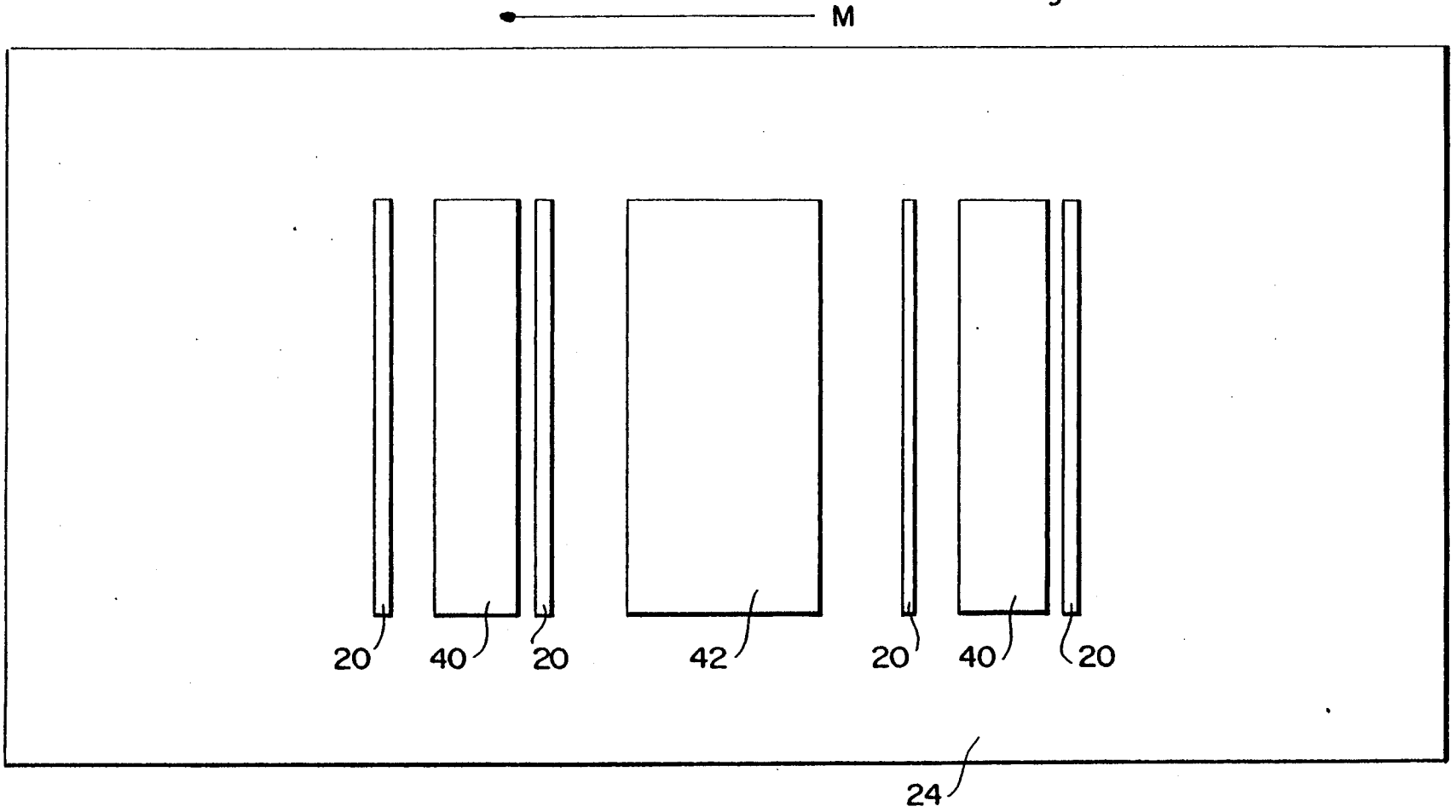
FIG. 3 is a top view of a gas management system illustrating the relative positions of particular baffles between adjacent, closely-spaced laydown positions along the direction of collection belt movement.

Referring now to FIG. 3, a gas management system and four aerodynamic shields 20 from a pair of double end spinneret assemblies are shown positioned above collection belt 24. The gas management system comprises a pair of pack baffles 40 and a positional baffle 42 positioned between the aerodynamic shields 20. The pack baffles 40 are positioned between adjacent aerodynamic shields 20 from the same double end spinneret assembly 10 while the positional baffle 42 is positioned between adjacent aerodynamic shields 20 from different double end spinneret assemblies. Preferably, the positional baffle 42 is positioned about half way between adjacent aerodynamic shields 20 while the pack baffles are positioned closer to the upstream aerodynamic shield 20 than the downstream aerodynamic shield 20. Positioning the pack baffles in this manner more adequately shields the laydown jets and helps to center and contain the fountain flow produced. It will be understood that additional double end spinneret assemblies and baffles 40 and 42 (not shown) may be used upstream and downstream along collection belt 24.

Figure 4:
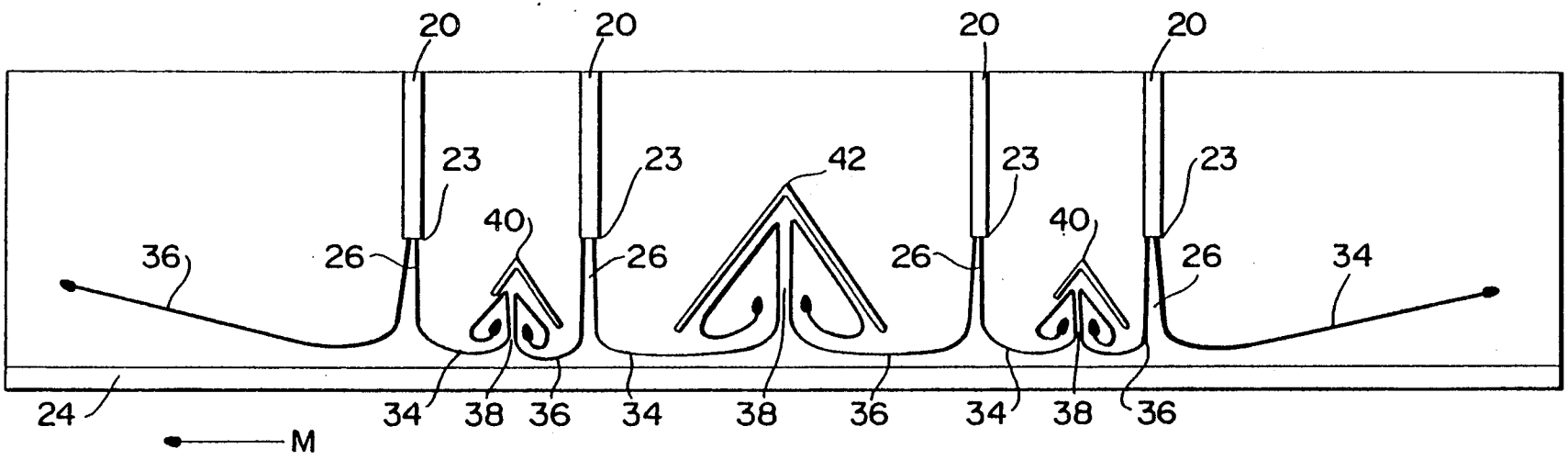
FIG. 4 is a side view of a preferred gas management system illustrating the flow patterns produced when inverted "V-shaped" baffles are positioned between adjacent, closely-spaced laydown positions.

Referring now to FIG. 4, a side view of the gas management system of FIG. 3 is shown. The four separate aerodynamic shields 20 each produce a laydown jet 26 at issue point 23 comprising a swath of fibrous material and a transporting gas. The downwardly directed laydown jets 26 each impact collection belt 24. As described before, the diverted exhaust gases 34 and 36 collide and fountain upward as stream 38. As the fountain stream 38 rises, it is collected and contained within suspended pack baffles 40 and positional baffle 42. Preferably, the pack baffles 40 comprise an inverted "V-shaped" trough having a downstream leg shorter than its upstream leg. This allows the laydown jets 26 to be angled slightly upstream against the collection belt 24 without the upstream laydown jet striking the upper surface of the downstream leg of pack baffle 40. The trough is open at each end and has an included angle of about 70 degrees. The width of the pack baffles 40 in the cross-direction is about 24 inches and the distance between the tip of the upstream leg of the pack baffles 40 and the surface of the collection belt 24 is about 5 inches. Additionally, the pack baffles 40 have an inside span of about 5 ½ inches. Preferably, the positional baffle 42 has an inside span of about 12 inches and an included angle of about 90 degrees. The width of the positional baffle 42 in the cross-direction is about 28 inches and the vertical distance between the tips of the legs of positional baffle 42 and the surface of collection belt 24 is about 4 inches. The positional baffle 42 is also open at both ends. It will be understood that other suitable baffle geometries are possible for use with the invention as long as they collect and contain fountain stream 38 and vent it away from the area of sheet formation. In particular, a flat horizontal plate would provide some degree of laydown jet to laydown jet stability. In use, the fountain stream 38 is deflected by baffles 40 and 42 and vented away from the area of sheet formation before it can recirculate into the laydown jets 26 comprising swath 30 and transporting gas 32. The deflected fountain stream 38 is vented in the cross-direction and out of the open ends of baffles 40 and 42. In this manner, the fountain stream 38 is prevented from disrupting the uniform formation of the fibrous sheet on collection belt 24.

Figure 5:
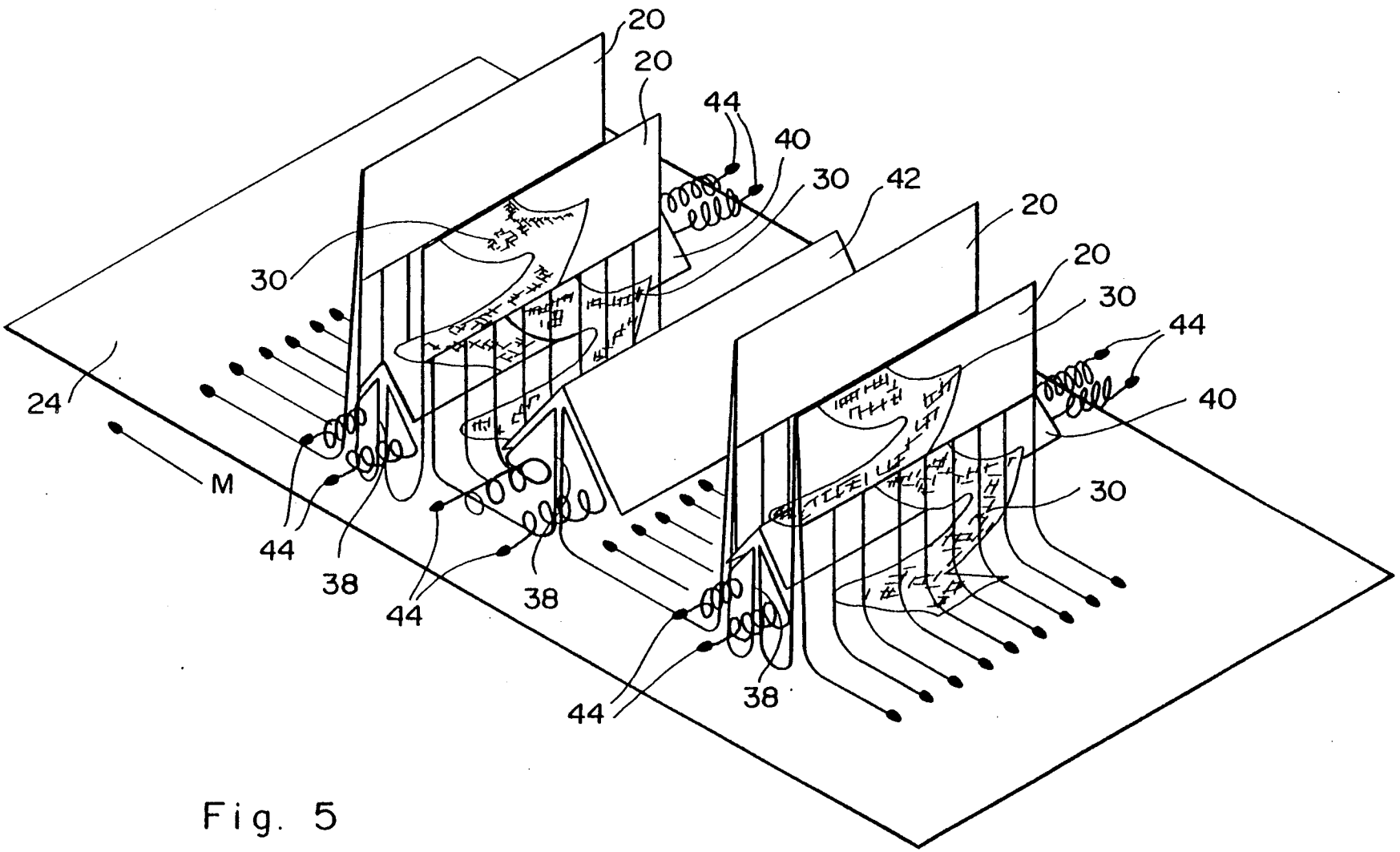
FIG. 5 is a top isometric view of the preferred gas management system of FIG. 4 further showing the effect of the baffles on the exhausted gas streams after the laydown jets have conveyed fibrous material to the collection belt.

Referring now to FIG. 5, the preferred gas management system of FIGS. 3 and 4 is shown in greater detail. The deflected fountain streams 38 are shown being vented in the cross-direction and exhausted out of baffles 40 and 42 in a spiraling flow pattern 44. Management of the turbulent fountain streams 38 allows the swath of fibrous material 30 to be uniformly deposited onto the collection belt 24. It will be understood that the best results are obtained when pack baffles 40 and positional baffle 42 are both used together, however the invention can also be effectively practiced without using the positional baffle 42 in connection with the pack baffles 40.

The effectiveness of the above-described gas management system will be better understood by reference to the following non-limiting examples. The results reported in these examples are believed to be representative but do not constitute all tests undertaken.

In these examples, sheet uniformity is defined as an index which is the product of the basis weight coefficient of variation times the square root of the basis weight in units of ounces per square yard. After a fibrous web is formed, it is separated from all the other webs so that its laydown pattern is not disturbed. It is then scanned about every 0.4 inches in the cross direction and the machine direction by a commercially available radioactive beta gauge. The sheet thickness data for one swath is used as a base to computationally create an entire sheet. One of these swaths is numerically deposited on a collection belt. Another swath is moved in the cross and machine directions and added to it just as it would be in the actual sheet formation. This process is repeated until a complete sheet has been formed. A total sheet basis weight is then determined, which has been validated by actual sheet basis weight measurements. This numerical sheet is then statistically analyzed to determine its uniformity index. The validity of this method of defining sheet uniformity quality has been verified over many years of commercial use and is well known to those skilled in the art of making spunbonded nonwoven sheets.

Conventional Single Spinneret Sheet Formation

Each spin orifice from a single pack produced approximately 170 pounds per hour of polymer solution and 60 $ft^3$/minute of transporting gas. The resulting web was electrostatically charged to aid in pinning the web to the collection belt. The webs were oscillated in the cross-direction at a nominal speed of 70 Hz and each laydown jet was angled such that it impinged against the direction of belt movement at a nominal angle of 5 degrees. By slightly angling the jets against the direction of belt movement, the effect of a boundary fluid layer on the belt can be significantly reduced. The distance from the issue point of the laydown jet to the collection belt was approximately 12 inches. Sheets typically produced by such an arrangement were measured to have an average uniformity index of 22.

Double End Spinneret Assembly Sheet Formation

A test was conducted using a double end spinneret assembly having adjacent, closely-spaced laydown jets. The spin orifice and spinneret geometry were essentially the same as described above, except that the downstream laydown jet was initially angled upstream at an angle of about 5 degrees and the upstream laydown et was initially angled upstream at an angle of about 7 degrees. However, due to the attractive forces of the closely-spaced laydown jets, the resulting upstream and downstream laydown jets actually impinged against the belt at an angle of about 5 degrees. The webs were oscillated at 55 Hz and an electrostatic charge was placed on each web. The total assembly polymer mass flow rate was nominally 170 pounds per hour and the transporting gas volumetric flow rate was approximately 60 $ft^3$/min The distance between the issue point of the laydown jet and the surface of the collection belt was approximately 10 inches. The laydown jet to laydown jet interaction was so severe that web was often lifted upward in the vicinity of the laydown jet issue point after impinging against the collection belt. No other surrounding laydown jets were operated during this test in order to eliminate the chance of additional interactions from adjacent laydown jets and to provide the best possible chance for stable sheet formation. The uniformity index from this test was 19.2 for the downstream swath and 21.2 for the upstream swath.

It is believed that double end spinneret assemblies will produce significant interferences or interactions between adjacent laydown jets, leading to fibrous laydown nonuniformities and subsequent sheet nonuniformities, if the laydown jets are horizontally spaced downstream from one another closer than about five (5) times the vertical distance between the laydown jet issue point and the surface of the collection belt.

Double End Spinneret Assembly Sheet Formation With Baffles

A test was conducted with a double end spinneret assembly using a pack baffle between adjacent laydown jets and above the surface of the collection belt. The laydown jet spacing and spinneret assembly design were the same as described above, except that the downstream laydown jet was initially angled upstream at an angle of about 0 degrees and the upstream laydown jet was initially angled upstream at an angle of about 10 degrees. However, due to the attractive forces of the closely-spaced laydown jets, the resulting upstream and downstream laydown jets actually impinged against the belt at an angle of about 5 degrees. The webs were oscillated at 60 Hz and an electrostatic charge was placed on each web. The total spinneret assembly polymer mass flow rate was nominally 155 pounds per hour and the transporting gas volumetric flow rate was about 55 $ft^3$/min. The distance from the laydown jet issue points to the surface of the collection belt was about 10 inches. The pack baffle comprised an inverted "V-shaped" trough with an inside span of 6-½ inches and an included angle of 70 degrees. The width of the pack baffle in the cross-direction was about 24 inches. The distance from the tip of the upstream leg of the pack baffle to the surface of the belt was about 5 inches.

An inverted "V-shaped" positional baffle was also positioned between adjacent double end spinneret assemblies. The positional baffle was approximately centered between adjacent laydown positions. The positional baffle had an approximate inside span of 12 inches with a 90 degree included angle and was positioned so that the distance from the tip of the legs of the baffle to the surface of the belt was about 4 inches. The width of the positional baffle in the cross-direction was about 28 inches.

Preferably, the span and height of the baffles should be at least one fourth the distance between the laydown jets in the direction of belt movement. Span requirements are normally dependent on variations in belt speed while height requirements are more dependent on variations in the volumetric flow rate of the laydown jets.

The laydown jet to laydown jet interactions were reduced so that the fibrous material impingement point on the belt remained stable and the electrostically charged web pinned when it reached the collection belt and did not rise upwardly towards the issue point of the laydown jets. The positional baffle and pack baffles vented the fountain flow away from the originating streams and prevented them from forming significant instabilities within them. The web stability from the issue point of the laydown jets to the collection belt was as good or better than that of more widely spaced laydown jets. The uniformity index for this test was 17.7 for the downstream laydown jet and 16.3 for the upstream laydown jet. Other tests have shown that the uniformity index is often improved 10 to 20% over fibrous sheets formed from conventional single spinnerets.

The foregoing examples demonstrate that interferences or interactions can be reduced or even prevented between the exhausted streams of closely-spaced laydown jets. The use of pack and positional baffles allows improved sheet uniformity and increased spinneret assembly capacity.

Although a particular embodiment of the present invention has been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the present invention.

I claim:

1. In a fibrous sheet laydown process in which fibrous material is flash spun from a plurality of adjacent spinneret assemblies and these fibrous material conveyed by a plurality of laydown jets onto a moving collection device to form a dense non-woven sheet on the collection device, and wherein the laydown jets issue from the plurality of adjacent spinneret assemblies which are positioned downstream from one another along the direction of collection device movement, with the horizontal distance between the issue points of adjacent laydown jets being less than about five (5) times the horizontal distance between the issue point of each laydown jet and the inner surface of the collection device, and wherein the fibrous material is separated from the laydown jets by the upper surface of the collection device thereby leaving an exhausted gas, the improvement comprising positioning deflector means between said adjacent laydown jets and above the upper surface of the collection device in order to vent the exhausted gas away from the laydown jets and the upper surface of the collection device.

2. The improvement according to claim 1 wherein the deflector means comprises an inverted trough that vents the exhausted gas in a cross-direction to that of the direction of collection device movement.

3. The improvement according to claim 1 wherein the deflector means comprises an inverted V-shaped trough with a span and height that are at least one fourth the horizontal distance between the issue points of adjacent laydown jets in the direction of collection device movement.

4. The improvement according to claim 1 wherein the deflector means is approximately centered between the issue points of adjacent laydown jets in the direction of collection device movement and is positioned above the upper surface of the collection device about one half the vertical distance between the issue points of the laydown jets and the upper surface of the collection device.

5. The improvement according to claim 1 wherein the collection device comprises an endless foraminous collection belt.

6. The improvement according to claim 1 wherein the deflector means is comprised of a non-conductive material.

7. The improvement according to claim 6 wherein the non-conductive material comprises an acrylic sheet material.

8. The improvement according to claim 1 wherein the fibrous sheet is comprised of overlapping swaths of plexifilaments.

* * * * *